250-506.1 SR
10/16/84 OR 4,477,731

United States Patent [19]

Smith

[11] Patent Number: 4,477,731

[45] Date of Patent: Oct. 16, 1984

[54] SELF-CLOSING SHIELDED CONTAINER FOR USE WITH RADIOACTIVE MATERIALS

[75] Inventor: Jay E. Smith, Pittsburgh, Pa.

[73] Assignee: The United States of America as represented by the Department of Energy, Washington, D.C.

[21] Appl. No.: 438,127

[22] Filed: Nov. 1, 1982

[51] Int. Cl.[3] ..... G21F 5/00

[52] U.S. Cl. ..... 250/506.1; 250/498.1

[58] Field of Search ..... 250/506.1, 498.1, 496.1; 220/334; 252/633; 376/272; D3/30.1; D9/420

[56] References Cited

U.S. PATENT DOCUMENTS 1,300,710 4/1919 Edwards .
2,642,541 6/1953 Young ..... 250/506.1
2,763,366 9/1956 Smith et al. ..... 206/4
3,065,308 11/1962 Suyeoka ..... 129/43
3,360,116 12/1967 Somers et al. ..... 206/45.2

FOREIGN PATENT DOCUMENTS 1218610 5/1960 France ..... 250/506.1

*Primary Examiner*—Janice A. Howell
*Assistant Examiner*—Jack I. Berman
*Attorney, Agent, or Firm*—Michael F. Esposito

[57] ABSTRACT

A container for storage of radioactive material comprising a container body and a closure member. The closure member being coupled to the container body to enable the closure body to move automatically from a first position (e.g., closed) to a second position (open).

5 Claims, 1 Drawing Figure

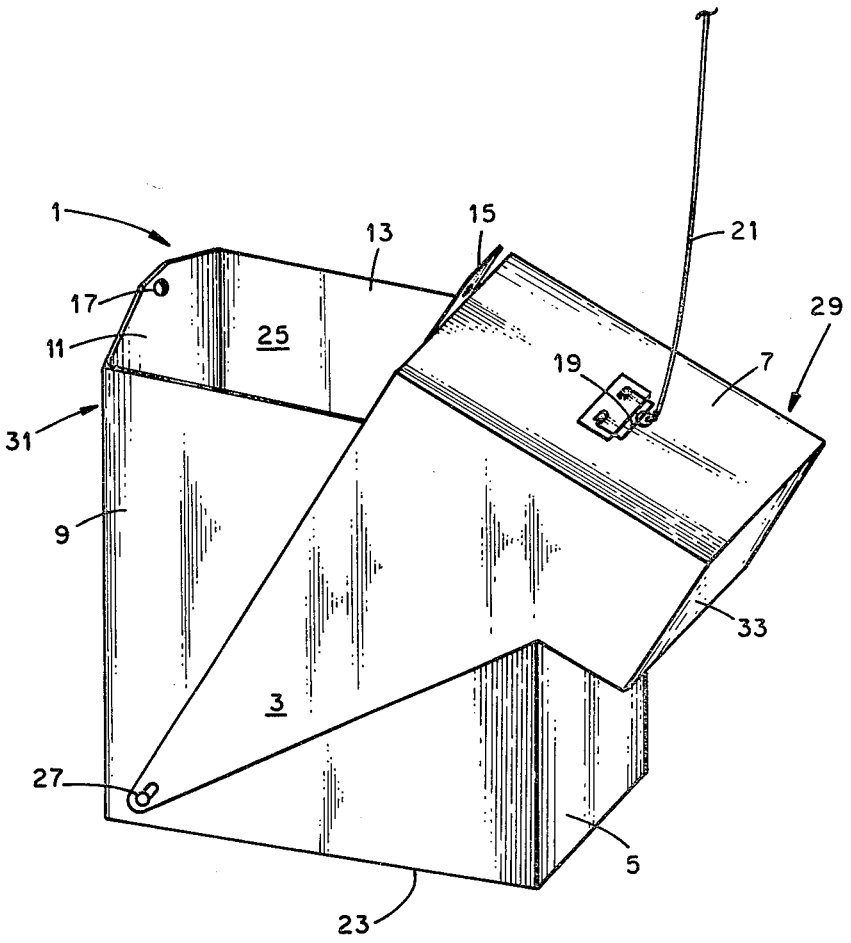
1
13
15
21
17
29
11
25
19
7
31
9
33
3
27
5
23

SELF-CLOSING SHIELDED CONTAINER FOR USE WITH RADIOACTIVE MATERIALS

The U.S. Government has rights in this invention pursuant to Contract No. DE-AC11-76PN00014 between the Department of Energy and Westinghouse Electric Corporation.

BACKGROUND OF THE INVENTION

This invention is directed to a container for storage and transportation of radioactive material. In particular, the radioactive storage container of the present invention is self-opening prior to loading and self-closing when a lifting force is applied to the container.

Protection from excessive radiation exposure is of paramount importance during handling of radioactive material. One means of achieving this objective is to substantially reduce the time during which, one is exposed to the radiation. In the many procedures involved during handling of radioactive material, it becomes necessary to open a container, place or remove the material in the container, and finally, install the lid on the container. All of these operations add significantly to the amount of time one is exposed to radiation. A container which can easily be opened and closed from a distance would significantly reduce the radiation exposure time during these operations. The container of the present invention substantially reduces the amount of time involved in opening and placing the lid upon the container. Accordingly, the total amount of radiation one is subjected to is substantially reduced.

SUMMARY OF THE INVENTION

It is the primary object of the present invention to provide a container for radioactive material which minimizes exposure to radiation.

It is another object of the present invention to provide a rectangular container for storage of radioactive material which minimizes radiation exposure.

It is still another object of the present invention to provide a container for storage of radioactive material which is provided with a self-opening and closing lid.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects of the present invention, as embodied and broadly described herein, the container of the present invention comprises a container body having a bottom wall, opposed side walls and opposed front and rear walls defining a receptacle open at its upper end; and a closure member including a cover and opposed side walls extending from cover, means for coupling the closure member and the container body one to the other to enable the closure member to move between a first position with the cover substantially closing the receptacle opening and a second position with the cover displaced from the opening permitting access to the container body. The coupling means is located relative to the closure member and the container body to enable the closure member to move from the first position to the second position absent an applied force.

In a preferred embodiment of the present invention the container further includes a means for retaining the closure member in the first position.

In a further preferred embodiment of the present invention the means for coupling includes a pivoting means laterally offset from the center of gravity of the closure member.

In a still further preferred embodiment the container of the present invention includes a lifting means coupled to the closure member laterally offset from the pivot point.

The container of the present invention greatly facilitates the operator during handling of radioactive material. For example, the container when placed on a support surface with no applied force on the closure member will automatically open due to the position of the coupling means with respect to the closure member and container body. Accordingly, the operator merely has to remove or place the radioactive material in the container without concern for removal of the container lid. In addition, the container will automatically close by merely applying a force to the closure member (e.g., lifting) substantially eliminating the time the container remains open. The container of the present invention provides a simple, economical and efficient means of reducing radiation exposure time during handling of radioactive material thereby reducing potential health hazards.

BRIEF DESCRIPTION OF THE DRAWINGS

The accompanying drawing which is incorporated in and forms a part of the specification, illustrates a preferred embodiment of the present invention, and together with the description, serves to explain the principles of the invention.

The drawing is a perspective view of a preferred configuration for the container of the present invention.

DETAILED DESCRIPTION OF THE INVENTION

Reference will now be made in detail to the present preferred embodiment of the invention, an example of which is illustrated in the accompanying drawing.

With reference to the Drawing, the container 1 of the present invention comprises container body 31 having bottom wall 23, opposed side walls 9 and 13, and opposed front and rear walls 11 and 5 respectively, defining receptacle open 25 at its upper end, closure member 29 including cover 7, opposed side walls (only one shown) and optionally, front wall 33, means for coupling 27 closure member 29 and container body 31 one to the other to enable closure member 29 to move between a first position with closure member 29 substantially closing receptacle opening 25 and a second position with closure member 29 displaced from opening 25 permitting access to container body 31, coupling means 27 is located relative to closure member 29 and container body 31 to enable closure member 29 to move from the first (closed) position to the second (open) position absent an applied force. Handle 19 is attached to closure member 29 at a point laterally offset from coupling means 27. Optionally, closure member 29 and container body 31 are provided with latch 15 and catch 17 respectively, enabling the maintainment of closure member 29 in the closed position.

Preferably, coupling means 27 includes pivoting means enabling closure member 29 to move in a swinging motion.

In operation, container 1 is placed in position adjacent the radioactive material. The lifting force applied via line 21 is released enabling closure member 29 to open automatically permitting access to receptacle opening 25. The radioactive material is loaded into a container body 31 by the operator. This may be done by any conventional means such as long handled implements. Closure member 29 is then lifted by handle 19 via line 21 automatically closing receptacle opening 25. Latch 15 and catch 17 may be provided on closure member 29 and container body 31 respectively enabling the operator to retain closure member 29 in the closed position.

It should be understood that container 10 may be lead-lined to ensure adequate protection from radiation especially during the handling of extremely active radioactive materials. In addition, it should be understood that the rectangular configuration shown in the drawing is merely preferred and other shapes (e.g., cubic) may be utilized in the practice of the invention.

The container of the present invention substantially eliminates the time involved in transferring radioactive material. Accordingly, the operators exposure to radiation is dramatically reduced greatly reducing radiation health hazards.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A container for storage of radioactive material comprising a container body having a bottom wall, opposed side walls and opposed front and rear walls defining a receptacle open at its upper end; and a closure member including a cover, and opposed side walls extending from said cover, means for coupling said closure member and said container body one to the other to enable said closure member to move between a first position with said cover substantially closing said receptacle opening and a second position with said cover displaced from said opening permitting access to said container body, said coupling means being located relative to said closure member and said container body to enable the closure member to move from said first position to said second position absent an applied force.

2. The container of claim 1 further including a means for retaining said closure member in said first position.

3. The container of claim 1 wherein the means for coupling includes a pivoting means laterally offset from the center of gravity of said closure member.

4. The container of claim 3 further comprising a means coupled to the closure member laterally offset from the pivot point whereby said closure member can be moved from said second position to said first position.

5. The container of claim 1 wherein said closure member further includes a front wall extending from said cover.

* * * * *